United States Patent [19]

Konishi et al.

[11] 4,143,513

[45] Mar. 13, 1979

[54] HEAT INSULATOR SUPPORT IN MANIFOLD REACTOR

[75] Inventors: Masami Konishi; Kazumasa Futamura, both of Toyota; Takashi Noda, Nagoya; Nobutaka Morikawa, Aichi, all of Japan

[73] Assignee: Toyota Jidosha Kogyo Kabushiki Kaisha, Aichi, Japan

[21] Appl. No.: 712,083

[22] Filed: Aug. 5, 1976

[51] Int. Cl.[2] ..... F01N 3/10

[52] U.S. Cl. ..... 60/282; 60/322

[58] Field of Search ..... 60/282, 322, 323

[56] References Cited

U.S. PATENT DOCUMENTS 3,845,621 11/1974 Goto ..... 60/322

3,850,453 11/1974 Bentley ..... 60/322

3,994,129 11/1976 Sakurai ..... 123/122 AB

*Primary Examiner*—Douglas Hart

*Attorney, Agent, or Firm*—Oblon, Fisher, Spivak, McClelland & Maier

[57] ABSTRACT

A support for a heat insulator material being disposed between an outer core of a re-combustion chamber and a manifold reactor housing thereof being formed by a grommet capping the edge of the heat insulator around the inlet ports of the housing, wherein the grommet is provided with an opening for loosely holding a port liner and is disposed between the housing and the outer core and has a deformable peripheral portion which substantially encloses and engages the heat insulator in a gap created by said deformable edge portion.

4 Claims, 6 Drawing Figures

HEAT INSULATOR SUPPORT IN MANIFOLD REACTOR

BACKGROUND OF THE INVENTION

1. Field of the Invention

The present invention relates generally to the heat insulator support in a manifold reactor and more particularly to such a support having a grommet of simple structure which can effectively hold the heat insulator and prevent it from being pulverized and discharged into the atmosphere.

2. Description of the Prior Art

Usually, in a manifold reactor, a re-combustion chamber is padded externally with a heat insulator for affording better preservation of heat. A common material from which the insulator is formed is a fibrous substance, such as a ceramic fiber, which, upon direct exposure to engine vibration or leaking gas, is liable to turn into dust and fly out or be discharged. A continuous portion of the heat insulator having uniform thickness is less liable to turn into dust and fly out, but a cut edge of the same is highly likely to do so. Particularly at the inlet port and its vicinity, where gaps are numerous between a port liner and a slide collar thereof, and between the outer core and the slide collar, pulverized heat insulator dust is liable to slip into such gaps, thereby jamming the slide collar, or to invade deeper into the re-combustion chamber and finally go out into the atmosphere through the outlet port.

A grommet capping the edge of the heat insulator around the inlet port will be useful for preventing the flying off of such dust.

In one conventional method, the heat insulator is held by a protector, which is welded to the reactor casing wall, but this method is not completely satisfactory since a cast casing has to be fabricated of a weldable expensive material and the welding requires high skill, resulting in a high cost of production.

SUMMARY OF THE INVENTION

An object of the present invention therefore is to effectively hold the heat insulator which fills the space between the outer core and the inner core in a manifold reactor.

Another object of the present invention is to prevent the heat insulator arranged between the outer core and the inner core in a manifold reactor from turning into dust through exposure to engine vibration and leaking gas.

Still another object of the present invention is to prevent dust from the heat insulator in a manifold reactor, disposed between the inner and outer cores thereof, from flying out.

Yet another object of the present invention is to prevent a decomposing heat insulator from invading the re-combustion chamber in a manifold reactor.

Yet another object of the present invention is to prevent a decomposing heat insulator from being discharged into the atmosphere.

The foregoing and other objects of the present invention are attained through the provision of a novel grommet having an opening for loosely holding a port liner of the manifold reactor housing, and adapted for arrangement between the housing and the outer core and being provided with a deformable peripheral edge portion, deformable upon assembly of the housing so as to secure a heat insulator in a gap arranged about the periphery of the opening therein.

BRIEF DESCRIPTION OF THE DRAWINGS

Other objects, features and attendant advantages of the present invention will be more fully appreciated as the same becomes better understood from the following detailed description when considered in connection with the accompanying drawings, wherein like reference characters designate like or corresponding parts throughout the several views and in which.

DETAILED DESCRIPTION OF THE PREFERRED EMBODIMENTS

Figure 1:
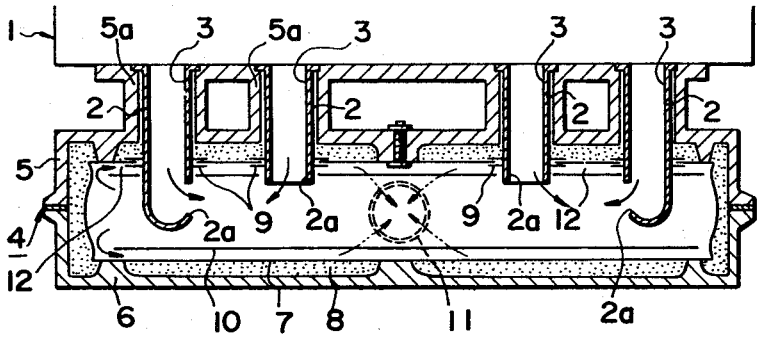
FIG. 1 is a cross-sectional view of a manifold reactor.

Referring now to FIG. 1, there is shown an engine 1 having a plurality of port liners 2 for communicating with each of the exhaust ports 3 thereof. A manifold reactor housing 4 for the engine is composed of two blocks 5 and 6, joined together, in one of which, namely block 5, a plurality of holes 5*a* is provided for insertion or reception therein of the port liners 2.

Within the manifold reactor housing 4 there is an outer core 7 and the space between the outer core 7 and the housing 4 is filled with a heat insulator 8. The part of the outer core 7 where the port liners 2 are to be inserted is provided with slide collars 9. At an adequate distance inside of the outer core 7 there is installed an inner core 10. The inner core 10 represents a square pillar, one side of which is open to the tip of the port liners 2, some of which have the tips 2*a* thereof being externally placed to open inwardly of the inner core 10.

On one central side of the manifold reactor housing 4 is provided a manifold reactor exhaust port 11, which is connected to an exhaust pipe, not shown. Under this arrangement, the exhaust gas coming out of a cylinder, not shown, of the engine 1 goes into the inner core 10, and moving from the opening at both ends and through a passage 12 formed between the inner core 10 and the outer core 7, the exhaust gas reaches the exhaust port 11, as indicated by the arrows in FIG. 1.

In a manifold reactor of this type arrangement, in which a certain "escape" has to be allowed between the port liners 2, to which engine vibration is directly transmitted, and the outer core 7, which is fitted through the heat insulator 8 to the housing 4, there are some gaps left between the port liner 2 and the slide collars 9 and between the outer core 7 and the slide collars 9, so that the slide collars 9 can be displaced both in the longitudinal and diametrical directions of the port liners 2.

In such a manifold reactor, the heat insulator 8 of fibrous substance, such as a ceramic fiber, which fills the space between the manifold reactor housing 4 and the outer core 7, turns at its edge into dust as a result of exposure to the engine vibration and leaking gas, whereby the dust slips into the gaps between the port liners 2 and the slide collars 9 and between the outer core 7 and the slide collar 9, thus obstructing the sliding movement of the slide collars 9, or it invades deeper through the gap between the inner core 10 and the port liners 2, finally reaching the inner core 10, which is the combustion chamber, such that it may be discharged through the passage 12 and out the exhaust port 11 into the atmosphere.

To prevent this, the heat insulator heretofore has been held by a protector, which was then welded to the housing wall, but this method, as already indicated, required the housing to be fabricated of a weldable material, this resulting in an increased cost, and such assembly work called for highly skilled operators, which even further increased the production cost.

Figure 2:
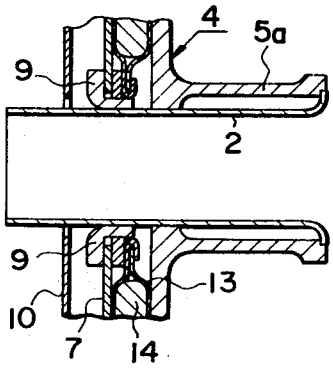
FIG. 2 is a sectional view showing an embodiment of the present invention as placed around the port liner in FIG. 1.

The present invention has been accomplished to eliminate this difficulty and thus reduce the cost of preventing a heat insulator from turning into dust which may fly off into the atmosphere. In one embodiment of the invention, illustrated in FIG. 2, a grommet 13 is provided between the housing 4 and the outer core 7 and the space externally formed around the grommet 13 is filled with a heat insulator 14.

Figure 3:
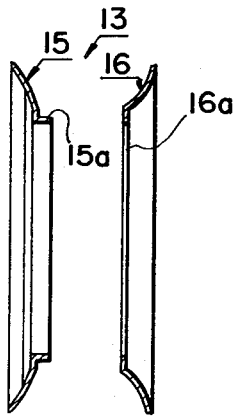
FIG. 3 is a sectional view illustrating the structure of a grommet according to the present invention.

FIG. 3 illustrates a specific embodiment of a grommet according to this invention. The grommet 13 shown therein represents a press-formed disc 15, one side or end of which is funnel-shaped, such as the left side, as seen in FIG. 3, and the other end or side of which, or the right side, is formed as a tube 15*a* which is inserted into a bored part 16*a* of a similar-shaped plate 16, also press-formed, and bent so as to tightly engage the plate 16 with the disc 15. At the time of this bending of the tube 15*a* and the engagement thereof with the plate 16, the heat insulator 14 is put between the two plates 15 and 16, thereby integrating the grommet 13 and the heat insulator 14. The grommet, thus obtained, is mounted between the housing 4 and the outer core 7, whereby the grommet 13 can be held more firmly between the two. In this case, it goes without saying that the grommet 13 is made slightly wider than the gap between the housing 4 and the outer core 7, so as to be deformed therebetween upon assembly as the housing 4 and the outer core 7 press against the disc 15 and the plate 16 of the grommet 13.

Figure 4:
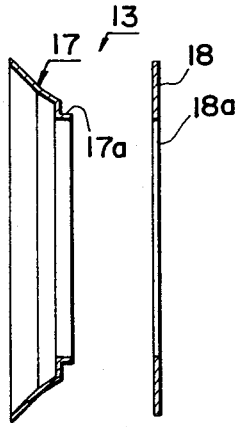
FIG. 4 is a sectional view of another embodiment of a grommet having a different structure from that shown in FIG. 3.

FIG. 4 illustrates another embodiment of the grommet according to this invention in which one plate side or end 17 is formed in approximately the same shape as the plate 15 of the embodiment shown in FIG. 3, while the other plate 18 is formed as a flat ring. The tubular portion 17*a* of the plate 17 goes into a central hole 18*a* of the plate 18 and is then bent so as to tightly engage the plate 18 with the plate 17. In this grommet, the part which holds the heat insulator 14 is thus nonsymmetric.

Figure 5:
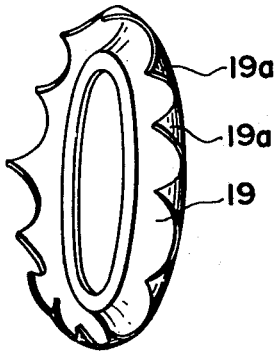
FIG. 5 is a perspective view illustrating still another embodiment of a grommet according to this invention.
Figure 6:
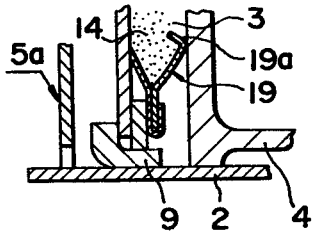
FIG. 6 is a sectional view showing the grommet of FIG. 5 in a service condition.

Still another embodiment of a grommet according to the present invention is illustrated in FIGS. 5 and 6. In this embodiment, a plurality of teeth 19*a* are provided on the periphery of one side or end plate 19, which otherwise substantially constitutes the same grommet piece as that shown in FIG. 3 as plate 16, and these teeth can obviously provide a secure grip on the heater insulator 14 when it is disposed between the plate 19 and another side plate, as shown in FIG. 6.

Such being the arrangement, the present invention can provide a simple grommet that can effectively hold the heat insulator and can prevent portions thereof from being turned into dust, which can fly out into the atmosphere.

Obviously many modifications and variations of the present invention are possible in light of these teachings. It is therefore to be understood that within the scope of the appended claims, the present invention can be practiced otherwise than as specifically described herein.

What is claimed as new and desired to be secured by Letters Patent of the United States:

1. A heat insulator support for use in a manifold reactor of an engine, comprising:
   - at least one port liner communicating with an engine exhaust port;
   - a housing having an opening therein for receiving said port liner;
   - an outer core located inside said housing;
   - an inner core located inside said outer core;
   - a grommet having an opening for loosely holding said at least one port liner, said grommet being disposed between said housing and said outer core and having a deformed peripheral edge portion deformed upon assembly of said housing with said inner and outer cores and said grommet being arranged therein; and
   - a heat insulator filling a gap created by said deformed edge of said grommet deformed during assembly, said housing and said outer core.

2. A heat insulator support in a manifold reactor as defined in claim 1, wherein said grommet comprises two press-formed plates, one of said two press-formed plates having a funnel shaped outside and a tube shaped end which is inserted into a bore of the outer of said two press-formed plates and bent so as to tightly engage said other plate with said one plate, and the periphery of said grommet filled with said heat insulator.

3. A heat insulator support in a manifold reactor as defined in claim 1, wherein said grommet comprises a flat plate having a central opening, a press-formed plate having a tubular end portion inserted into said central opening of said flat plate and then bent such that said press-formed plate tightly engages said flat plate, and the periphery of said plates, which is open, is filled with the heat insulator.

4. A heat insulator support in a manifold reactor as defined in claim 2, wherein a large number of teeth are cut on the peripheral edge of one of the plates constituting said grommet so that these teeth can grip the heat insulator when the apparatus is assembled.

* * * * *

UNITED STATES PATENT AND TRADEMARK OFFICE

CERTIFICATE OF CORRECTION

PATENT NO. : 4,143,513

DATED : March 13, 1979

INVENTOR(S) : Masami Konishi Et Al

It is certified that error appears in the above-identified patent and that said Letters Patent are hereby corrected as shown below:

Please insert the following priority data:

--[30]-- December 29, 1975 [JP] Japan...50-178787-- rather than no priority data appearing in the Letters Patent.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*